US010883763B2

(12) United States Patent
Horvath

(10) Patent No.: US 10,883,763 B2
(45) Date of Patent: Jan. 5, 2021

(54) DRYING SYSTEM AND APPARATUS

(71) Applicant: Kenneth Horvath, Prescott, AZ (US)

(72) Inventor: Kenneth Horvath, Prescott, AZ (US)

( * ) Notice: Subject to any disclaimer, the term of this patent is extended or adjusted under 35 U.S.C. 154(b) by 48 days.

(21) Appl. No.: 15/888,748

(22) Filed: Feb. 5, 2018

(65) Prior Publication Data

US 2019/0242649 A1 Aug. 8, 2019

(51) Int. Cl.
*F26B 5/04* (2006.01)
*F26B 21/00* (2006.01)

(52) U.S. Cl.
CPC ..... *F26B 21/006* (2013.01); *F26B 21/003* (2013.01)

(58) Field of Classification Search
CPC ..... F26B 21/006; F26B 21/003
USPC ..... 34/413
See application file for complete search history.

(56) References Cited

U.S. PATENT DOCUMENTS 3,577,650 A * 5/1971 Brahm ..... D06F 58/14 34/622
6,393,724 B1 5/2002 Apple et al.
6,647,639 B1 11/2003 Storrer
6,886,271 B2 5/2005 Storrer
9,009,986 B1 * 4/2015 Chang ..... F41A 3/66 33/640
9,015,955 B2 * 4/2015 Vezina ..... D06F 58/14 211/182
2005/0160617 A1 * 7/2005 Fouts, II ..... A43D 3/1408 34/202
2006/0254073 A1 * 11/2006 Zhen ..... A45D 20/10 34/96
2007/0227163 A1 * 10/2007 Storrer ..... F24F 7/007 62/93
2010/0074700 A1 * 3/2010 Canino ..... B23Q 17/24 408/16
2012/0273377 A1 * 11/2012 Amatrudo ..... B25H 3/006 206/373
2013/0055893 A1 * 3/2013 Lowe ..... A01G 9/246 95/92
2016/0114410 A1 * 4/2016 Lai ..... B23B 51/0473 408/225

* cited by examiner

*Primary Examiner* — John P McCormack
(74) *Attorney, Agent, or Firm* — Zeman-Mullen & Ford, LLP

(57) ABSTRACT

A drying system and apparatus that includes a drying apparatus having a housing having opposite open ends, a plurality of sequentially spaced fans contained within the housing, and a cover member for covering an open end of the housing with the cover member containing a plurality of openings that are in communication with an interior of the housing. The drying system also includes a kit containing various components for drilling into cabinetry or similar enclosed structures and connecting the drying apparatus to the openings that are drilled into the cabinetry or similar enclosed structures.

21 Claims, 13 Drawing Sheets

DRYING SYSTEM AND APPARATUS

FIELD OF INVENTION

The present invention generally relates to a drying system and apparatus that is useful in the restoration industry and that is particularly useful in dehumidifying areas and structural drying. The drying system and apparatus of the present invention can also be used to treat cabinets and interstitial spaces for termites and bedbugs. The drying system and apparatus includes a drying device having a housing with opposite open ends, at least one fan contained within the housing, and a cover member having a plurality of circular openings therethrough that covers one of the open ends of the housing. The drying system also has a number of other parts including components used to create openings into closed structures that need to be dried and components that direct air from the drying device into, or out of, the openings to facilitate drying.

BACKGROUND OF THE INVENTION

Storms, flooding, and burst pipes can cause water damage in homes that require wall cavities, cabinets, and other interstitial small spaces to be dried as part of the restoration process. Moisture trapped within cabinets and wall cavities can cause structural damage as well as the growth of mold, mildew, and bacteria.

In order to dry wall cavities, holes are drilled into the wall to enable air to flow into the space between the walls studs. Baseboards are preferably removed first and holes are then drilled into the wall at floor level so that the holes can later be repaired and covered by the baseboards after drying the wall cavities.

When drying wall cavities, holes drilled into drywall can be easily patched. However, extra care must be taken when drying cabinets and vanities since holes drilled into cabinets and vanities can remain visible. In order to dry cabinets and vanities, holes are preferably drilled through the toe-kicks and toe-kick fascia (the cosmetic cover on the bottom portion of the cabinet or vanity) because they are usually removable and/or replaceable. If there is no toe-kick or access to the toe-kick then holes may be drilled into the wall behind the cabinet (if accessible) and through the back wall of the cabinet itself. Since these holes are located out of sight, they can be easily repaired without detracting from the look of the cabinet or vanity.

Existing air movers and drying systems used to dry wall cavities and cabinets utilize devices that produce either low pressure with high air flow or high pressure with low air flow. These systems and devices are inefficient in that they take longer to dry enclosed areas than a system and device that can produce high pressure and high air flow. Accordingly, there is a need for an efficient drying system and apparatus for enclosed spaces that produces high pressure combined with high air flow which reduces the time and cost for drying enclosed spaces.

SUMMARY OF THE INVENTION

The present invention is directed to a drying system and apparatus for drying wall cavities, cabinets and other interstitial small spaces. The drying system and apparatus of the present invention can also be used to treat cabinets and interstitial spaces for termites and bedbugs. The drying apparatus includes a housing having an open first end and an opposite open second end, at least three sequentially positioned fans contained within the housing, and a cover member for covering the first open end of the housing that has a plurality of circular shaped openings that are in communication with an interior of the housing. The plurality of circular shaped openings may have a diameter within a range of 1 to 1.5 inches. A plurality of cylindrical tube members may be connected to the plurality of circular shaped openings in the cover member so that the plurality of cylindrical tube members extend away from the interior of the housing. The plurality of cylindrical tube members may be formed contiguously with the plurality of circular shaped openings in the cover member such that the cover member and cylindrical tube members are formed or molded from a single piece.

The housing for the drying apparatus may have a hollow cylindrical shape and at least one wheel member may be connected to the hollow cylindrical shaped housing near the second end of the housing. In addition, a support member may be connected to the hollow circular shaped housing near the first open end of the housing for holding the first open end of the housing above a lowermost position of the wheel member. The plurality of circular shaped openings contained in the cover member that covers the first open end of the housing are therefore positioned at a height that is higher than the wheel member. The drying apparatus may also contain a control means for separately activating the three sequentially positioned fans. The drying apparatus may also include a filter member connected to the open second end of the housing for filtering air that is drawn into the housing and then pushed out of the housing by the three sequentially spaced fans.

The cover member that covers the first open end of the housing may be removable so that it can be connected to the opposite open second end of the housing to enable air to be suctioned from the first end of the housing to the second end of the housing instead of air being forced out of the first end of the housing. The drying apparatus may also include a second cover member for covering the second end of the housing while the first end of the housing is covered with the cover member.

The present invention is also directed to a drying system kit that includes a drying apparatus having a housing with open first and second opposite ends, at least one fan contained within the housing, and a cover member having a plurality of circular shaped openings for covering one of the first and second open ends of the housing, at least one drilling rod, a drill bit and/or hole saw that is attachable to the drilling rod, a plurality of air flow rods, a kickstand guide through which the drilling rod and air flow rods can be inserted, a flexible hose that can be cut into varying lengths, and a plurality of end caps or plugs, internal or external, that can cover the plurality of circular shaped openings in the cover member of the drying apparatus, the open ends of the plurality of air flow rods, and/or the open ends of the flexible hose member that is cut into varying lengths. The drying system kit may also include a drill tool that can be connected to the drilling rod.

The drying system kit may also include one or more first connector members for coupling one or more of the varying lengths of hose members that have been cut form the flexible hose member. In addition, the drying system kit may include one or more second connector members for attaching the plurality of hose members cut from the flexible hose member to the plurality of circular shaped openings in the cover member of the drying apparatus.

The drying system kit may also include a carrying case for storing and retaining the drilling rod, the drill bit and/or hole saw, the plurality of flow rods, the kickstand guide, and the plurality of end caps/plugs. The drill tool and/or the flexible hose member that can be cut into varying lengths may also be stored and retained within the carrying case.

The present invention is also directed to a method for drying cabinetry that includes the steps of 1) attaching a drill bit or hole saw to a first end of a drilling rod and inserting the drilling rod through a kickstand guide, 2) attaching a drill to the second opposite end of the drilling rod and lining up the kickstand guide to the toe kick, side, or base of a cabinet, 3) drilling into the cabinet with the drilling rod and the drill bit or hole saw until the drill bit or hole saw has drilled a hole into the cabinet and/or a wall behind the cabinet, 4) moving the kickstand guide, the drilling rod and the drill bit or hole saw out of and away from the cabinet or wall behind the cabinet and inserting a first end of an air flow rod into the hole in the cabinet until it reaches a back of an inside of the cabinet and/or wall behind the cabinet, and 5) attaching s second opposite end of the air flow rod to a first end of a flexible hose member and attaching a second opposite end of the flexible hose member to an air mover or drying apparatus having at least one fan. The method for drying cabinetry may further include the step of attaching an end cap having a plurality of openings to the first end of the air flow rod before inserting it into the hole in the cabinet.

The step of attaching the second opposite end of the flexible hose member to an air mover or drying apparatus may include the step of attaching the second opposite end of the flexible hose member to one of a plurality of openings in a cover member that is connected to the air mover or drying apparatus. The air mover or drying apparatus that is used in the method for drying cabinetry may include an air mover or drying apparatus that contains at least three sequentially positioned fans.

BRIEF DESCRIPTION OF THE DRAWINGS

The subject invention will hereinafter be described in conjunction with the appended drawing figures, wherein like numerals denote like elements.

DESCRIPTION OF EXEMPLARY EMBODIMENTS

Figure 1:
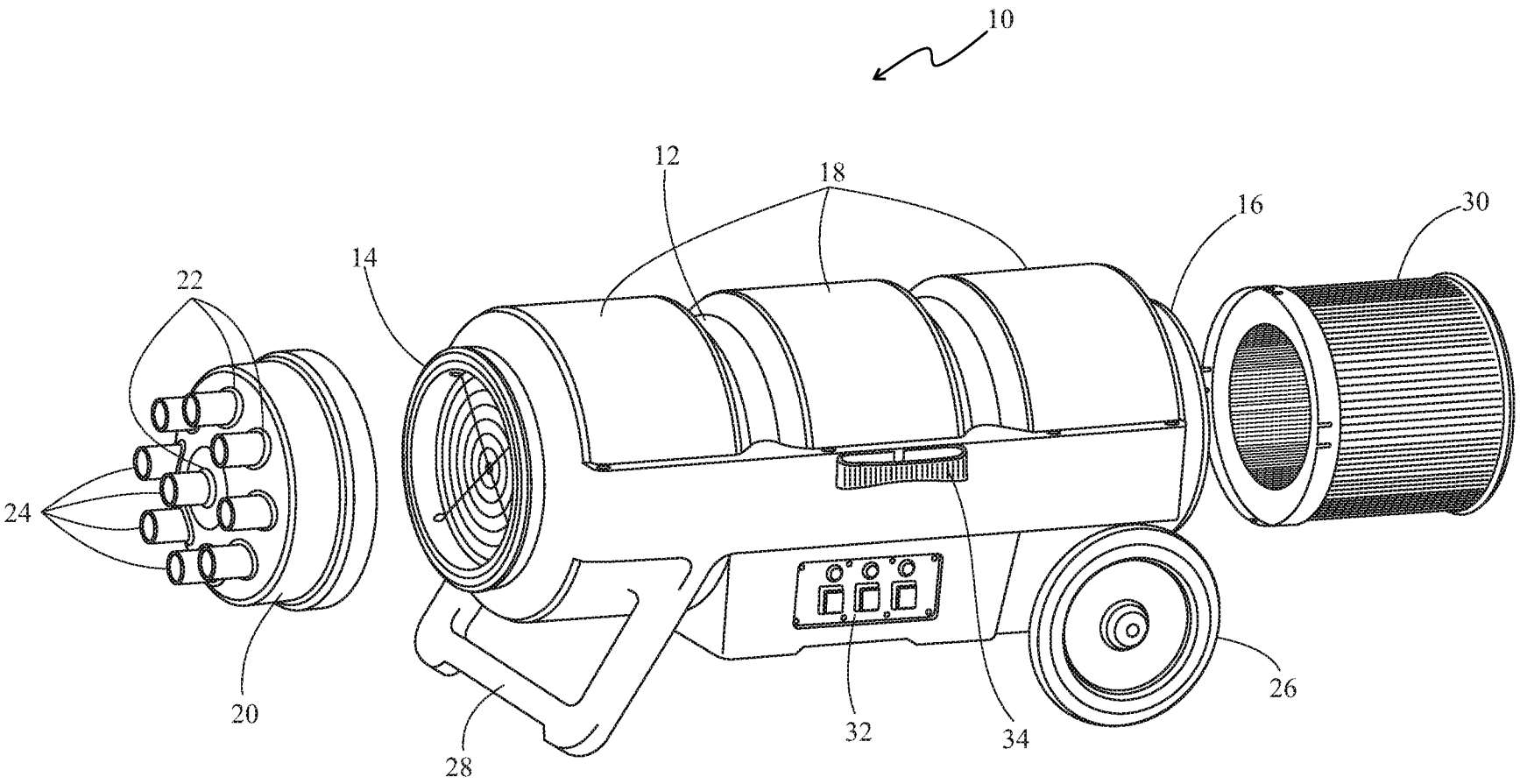
FIG. 1 is an exploded side perspective view of the drying apparatus of the present invention.

An exploded view of the drying apparatus 10 of the present invention is shown in FIG. 1 and includes a housing 12 having an open first end 14 and an opposite open second end 16, three sequentially positioned fans 18 contained within housing 12, and a cover member 20 having a plurality of circular shaped openings 22 therein where the cover member is positioned to cover the open first end 14 of the housing 12. The plurality of circular shaped openings 22 may have a diameter within a range of 1 to 1.5 inches to enable the sequentially positioned fans 18 and the circular shaped openings 22 (and subsequent components connected to the circular shaped openings) to work in conjunction with one another to produce high air pressure combined with high air flow to dry structures and enclosed spaces during operation of the drying apparatus 10. Cover member 22 may include a plurality of cylindrical tube members 24 which have an interior diameter equivalent to the diameter of the circular shaped openings 22 in the cover member such that a cylindrical tube member 24 is connected to each of the circular shaped openings 22 in a manner that has the cylindrical tube members 24 extending away from the interior of the housing 12. The cylindrical tube members 24 may be formed contiguously with the plurality of circular shaped openings 22 in the cover member 20 such that the cover member 20 and cylindrical tube members 24 are formed or molded from a single piece. The plurality of circular shaped openings 22 and cylindrical tube members 24 may be positioned in a circular configuration about the circumference of cover member 20 with openings 22 and tube members 24 also positioned within the circular configuration. In one exemplary embodiment, there are seven cylindrical tube members connected to seven circular shaped openings, respectively, positioned around the circumference of cover member 20 and one cylindrical tube member connected to one circular shaped opening positioned in the center of cover member 20.

Drying apparatus 10 may also include at least one wheel member 26 connected to the housing 12 near the opposite second open end 16 of the housing 12 for facilitating movement and transport of the drying apparatus 10. Drying apparatus 10 may also include a support member 28 connected to the housing 12 near the first open end 14 of the housing 12 for supporting the first open end 14 of the housing 12 above the ground and positioning the plurality of circular shaped openings 22 in cover member 20 above the height of wheel member 26 to provide for easy connection of flexible tube members (discussed later) to the plurality of cylindrical tube members 24 of cover member 20. Support member 28 may also be used as a handle to move and transport drying apparatus 10. A filter member 30 may be attached to the opposite second open end 16 of housing 12 to filter the air being drawn in by the sequentially spaced fans 18 so that filtered air is forced out of the circular shaped openings 22 and cylindrical tube members 24 of cover member 20 for drying. A control means may be located on an outer surface of housing 12 for separately activating the sequentially spaced fans 18. In addition, drying apparatus 10 may include a separate handle 34 attached to the housing 12 near a midpoint on the housing 12 to facilitate picking up and hand carrying the drying apparatus 10.

It will be understood by those skilled in the art that it may be possible to achieve high air pressure combined with high air flow for drying by including at least two sequentially positioned fans within housing 12 and configuring circular shaped openings 22 and cylindrical tube members 24 with inner diameters within a range of 1 to 1.5 inches. Cover member 20 may be removable so that it can be removed from the open first end 14 of housing 12 and moved to the opposite open second end 16 of housing 12 so that the air flow is reversed and a suction is created that draws air from the outside of housing 12 to the inside of housing 12. Flexible tube members that are connected to cylindrical tube members 24 in housing 12 can then be used to suction moisture from an enclosed area or structure that needs to be dried. The removable cover member 20 may be positioned over filter member 32 so that air that is suctioned into housing 12 is filtered before being expelled through the open first end 14 of housing 12.

Figure 2:
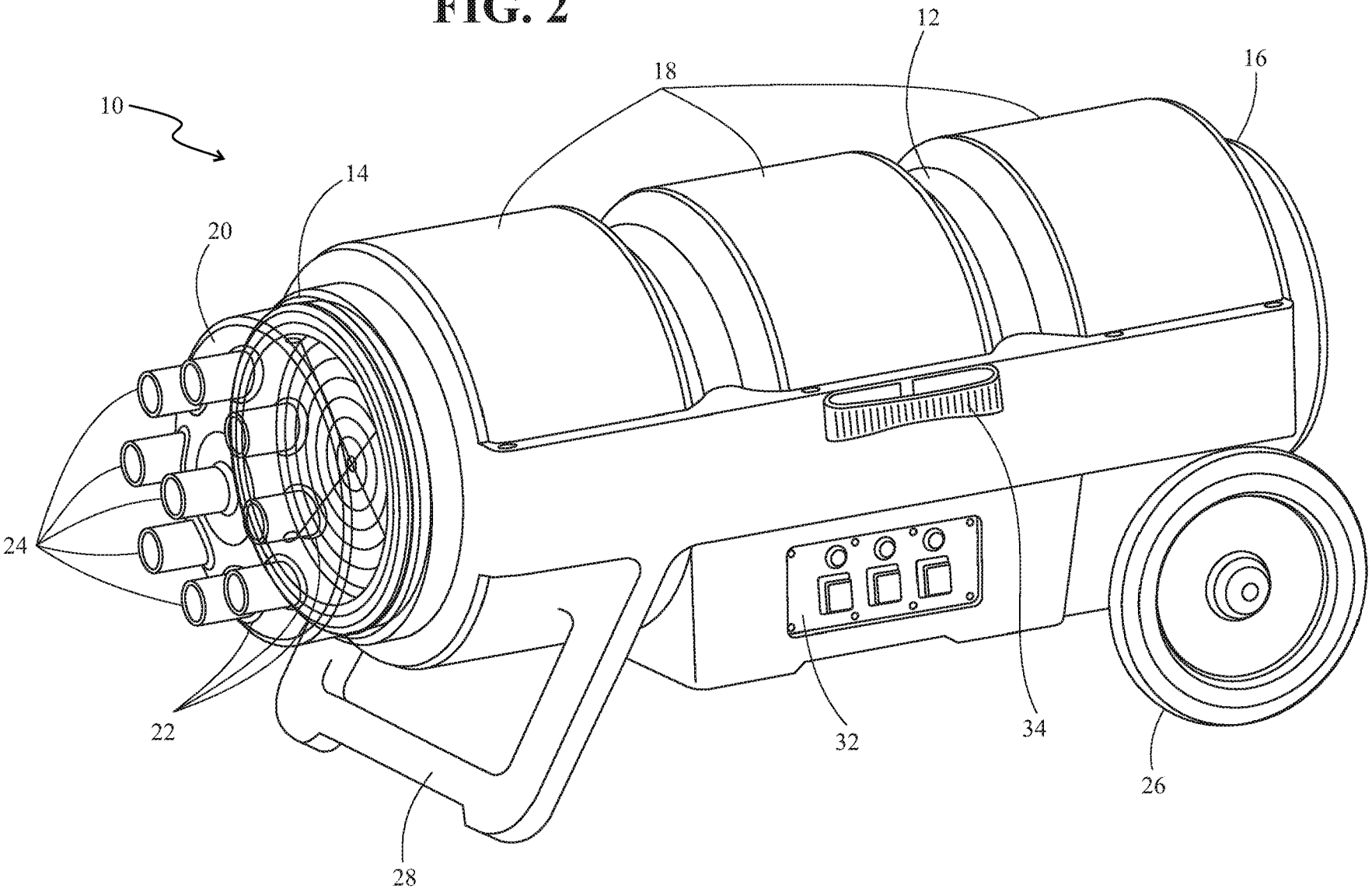
FIG. 2 is a side perspective view of the drying apparatus of the present invention showing the front of the drying apparatus with a cover member having a plurality of openings.
Figure 3:
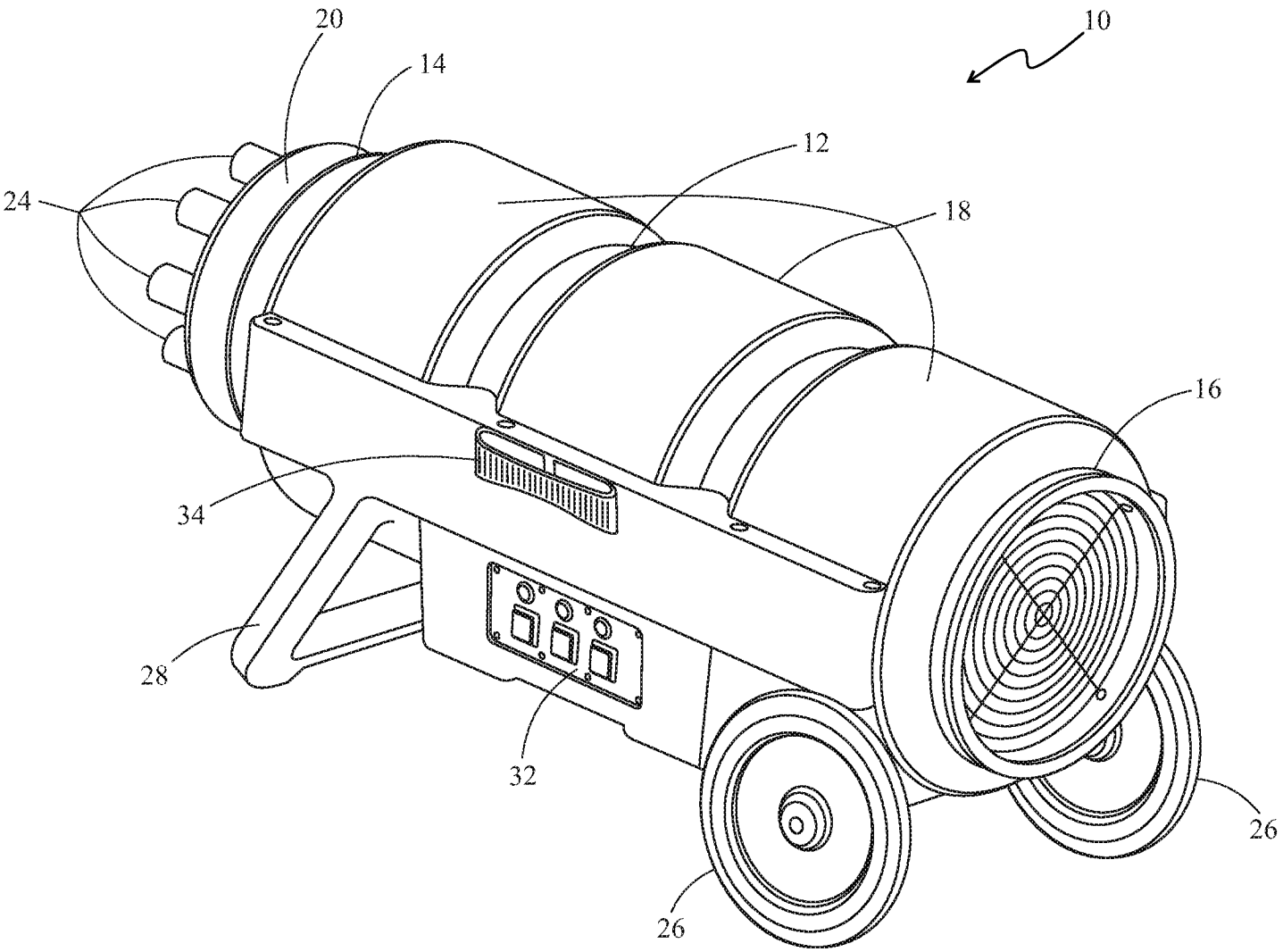
FIG. 3 is a side perspective view of the present invention showing the rear of the drying apparatus which may contain a filter (not shown)
Figure 4:
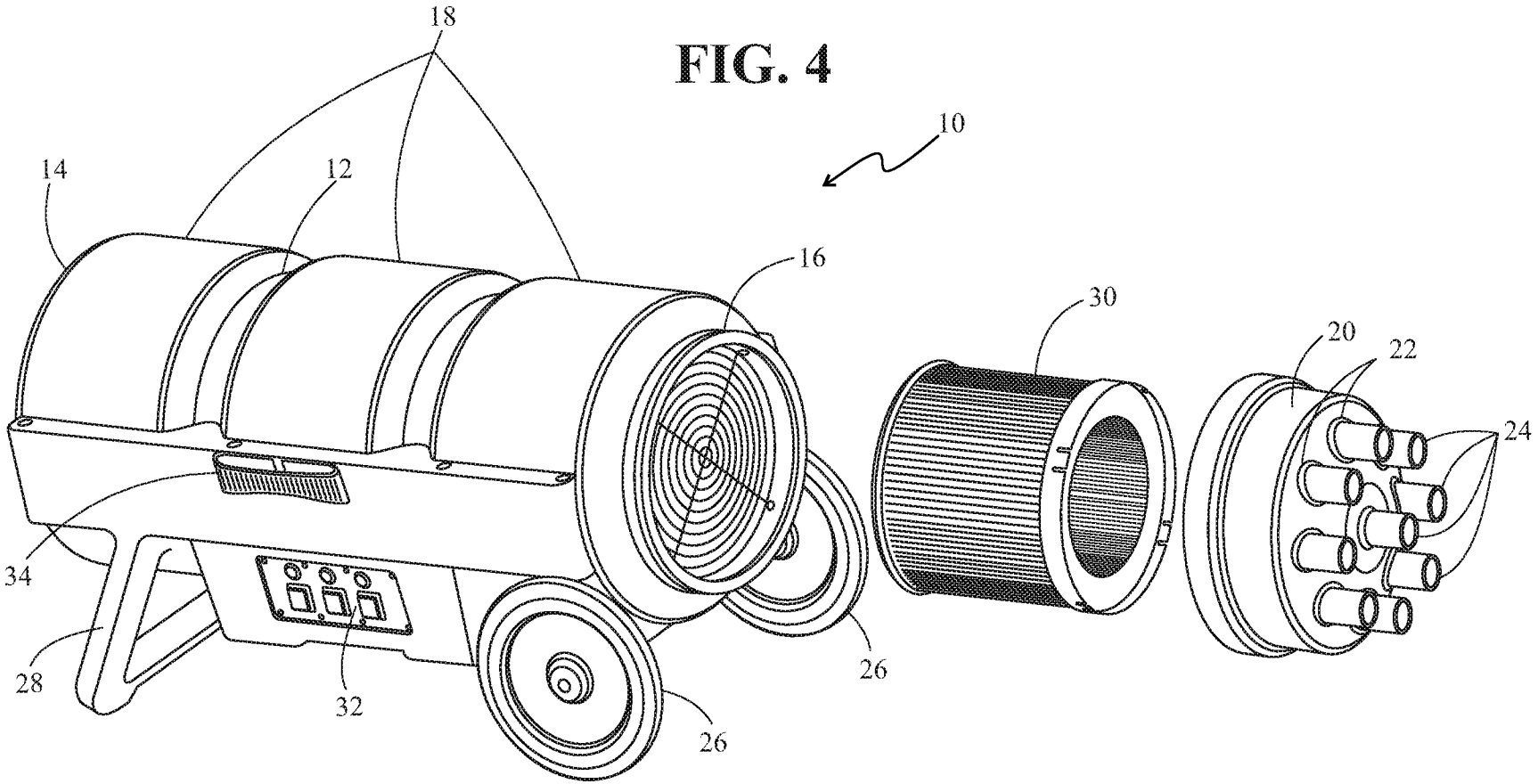
FIG. 4 is an exploded side perspective view of the present invention showing the rear of the drying apparatus with a filter and the cover member moved from the front of the drying apparatus to the rear of the apparatus to cover the filter.

FIG. 2 is a side perspective view of the drying apparatus 10 of the present invention illustrating the front of the drying apparatus 10 which shows cover member 20 of air drying apparatus 10 connected to the open first end 14 of housing 12. FIG. 3 is a side perspective view of the present invention showing the rear of the drying apparatus which shows the opposite open second end 16 of housing 12. FIG. 4 is an exploded side perspective view of the present invention showing the rear of the drying apparatus 10 with a filter 30 and the cover member 20 moved from the front of the drying apparatus 10 to the rear of the drying apparatus 10 to cover the filter member 30. When the drying apparatus 10 is used in this configuration, the sequentially positioned two or more fans 18 suck air through cylindrical tube members 24 and circular shaped openings 22 of cover member 20 and expel it through open first end 14 of housing 12. This enables flexible tube members connected to cylindrical tube members 14 in cover member 20 to draw or vacuum moisture from enclosed areas or structures that need to be dried. In contrast, the configuration of the drying apparatus 10 shown in FIGS. 1-3 causes air to be forced through flexible tube members connected to the cylindrical tube members 24 in cover member 14 so that high pressure combined with high air flow is directed to enclosed areas and structures that need to be dried. It will be understood by those skilled in the art that a second cover member may be included with the drying apparatus 10 that has openings like cover member 20 so that cover member 20 does not need to be removed and replaced at the opposite open second end 16 of housing 12. If there are two cover member similar to cover member 20 with one being placed at each end of housing 12 then a user needs to attach flexible tubing to openings in only one cover member depending on whether forced air at high pressure combined with high air flow is desired or a vacuum pressure is desired.

The present invention is also directed to a drying system kit which utilizes and/or includes the air drying apparatus 10 described above with reference to FIGS. 1-4. The drying system kit includes at least one drilling rod 40, at least one drill bit and/or hole saw 42 that is attachable to the drilling rod 40, a plurality of air flow rods 44 having openings 46 contained along the lengths of the air flow rods 44, at least one kickstand guide 48 through which the drilling rod 40 and the air flow rods 44 can be inserted, a flexible hose member 50 that can be cut into varying lengths, and a plurality of end caps 52 capable of covering the circular shaped openings 22 and cylindrical tube members 24 in the cover member 20 of the drying apparatus 10, at least one open end of the air flow rods 44, and/or at least one open end of the flexible hose member 50. The drying system kit may also include a drill tool 54 that can be connected to the drilling rod 40, one or more first connector members 56 that can couple open ends of one or more hose members 51 that have been cut from the flexible hose member 50, and one or more second connector members 58 that are capable of attaching an open end of the one or more hose members 51 to the plurality of circular shaped openings 22 and/or the plurality of cylindrical tube members 24 in cover member 20. The drying system kit may also include a carrying case 60 for retaining and storing one or more of the components of the drying system kit described above other than the drying apparatus 10.

The present invention is also directed to a method for drying enclosed spaces and structures including cabinetry that includes the steps of attaching a drill bit or hole saw to a first end of a drilling rod and inserting the drilling rod through a kickstand guide, attaching a drill to the second opposite end of the drilling rod and lining up the kickstand guide to a toe kick, side, or base of a cabinet, drilling into the cabinet with the drilling rod and the drill bit or hole saw until the drill bit or hole saw has drilled a hole into the cabinet and/or a wall behind the cabinet, moving the kickstand guide, the drilling rod and the drill bit or hole saw out of and away from the cabinet and/or wall behind the cabinet and inserting a first end of an air flow rod having a plurality of openings along its length into the hole in the cabinet until it reaches a back of an inside of the cabinet or the wall behind the cabinet, and attaching a second opposite end of the air flow rod to a first end of a flexible hose member and attaching a second opposite end of the flexible hose member to an air mover having at least one fan.

Figure 5:
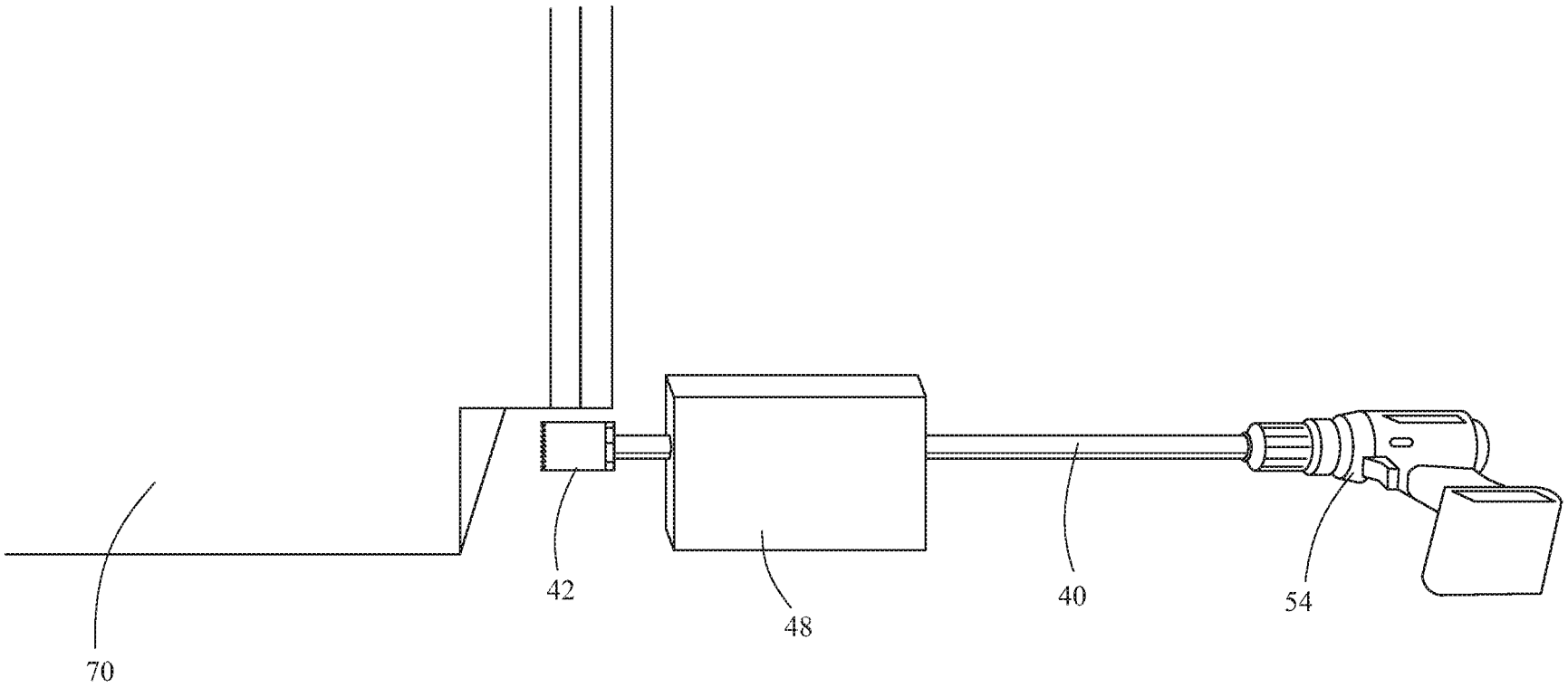
FIG. 5 shows the drill, drilling rod, kickstand guide, and hole saw/drilling bit (which are some of the components of the drying system kit of the present invention) joined together to prepare for drilling a hole into the base of a cabinet.
Figure 6:
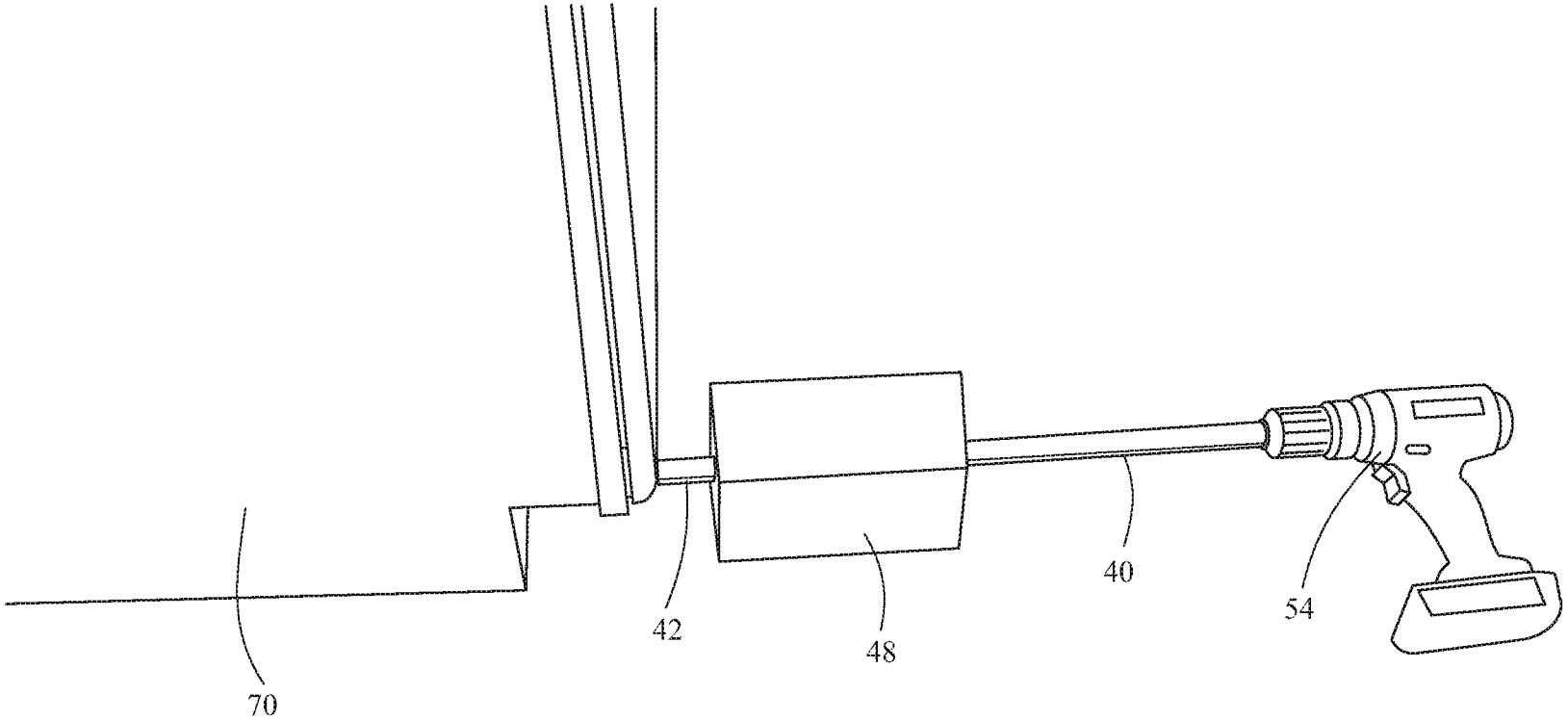
FIG. 6 shows the hole saw/drilling bit depicted in FIG. 5 positioned closer to the base of the cabinet in preparation for drilling.

FIG. 5 shows the drill tool 54, drilling rod 40, kickstand guide 48, and hole saw/drilling bit 42 (which are some of the components of the drying system kit of the present invention) joined together to prepare for drilling a hole into the base of a cabinet. The drill bit/hole saw 42 is attached to the drilling rod 40 and then the drill bit/hole saw 42 and drilling rod 40 are inserted through an opening in the kickstand guide 48. The drill 54 is attached to the other end of the drilling rod 40 and the kickstand guide 48 is lined up with the toe kick or base of the cabinet 70 for drilling. The kickstand guide 48 keeps the drill bit/hole saw 42 at the correct angle while drilling into the cabinet 70 and/or the wall behind the cabinet 70. FIG. 6 shows the drill bit/hole saw 42 depicted in FIG. 5 positioned closer to the base of the cabinet 70 in preparation for drilling. The drill tool 54 is then used to drill the drill bit/hole saw 42 into the cabinet 70 and the drilling rod 42 moves through the kickstand guide 48 as the drill bit/hole saw 42 drills into the cabinet 70.

Figure 7:
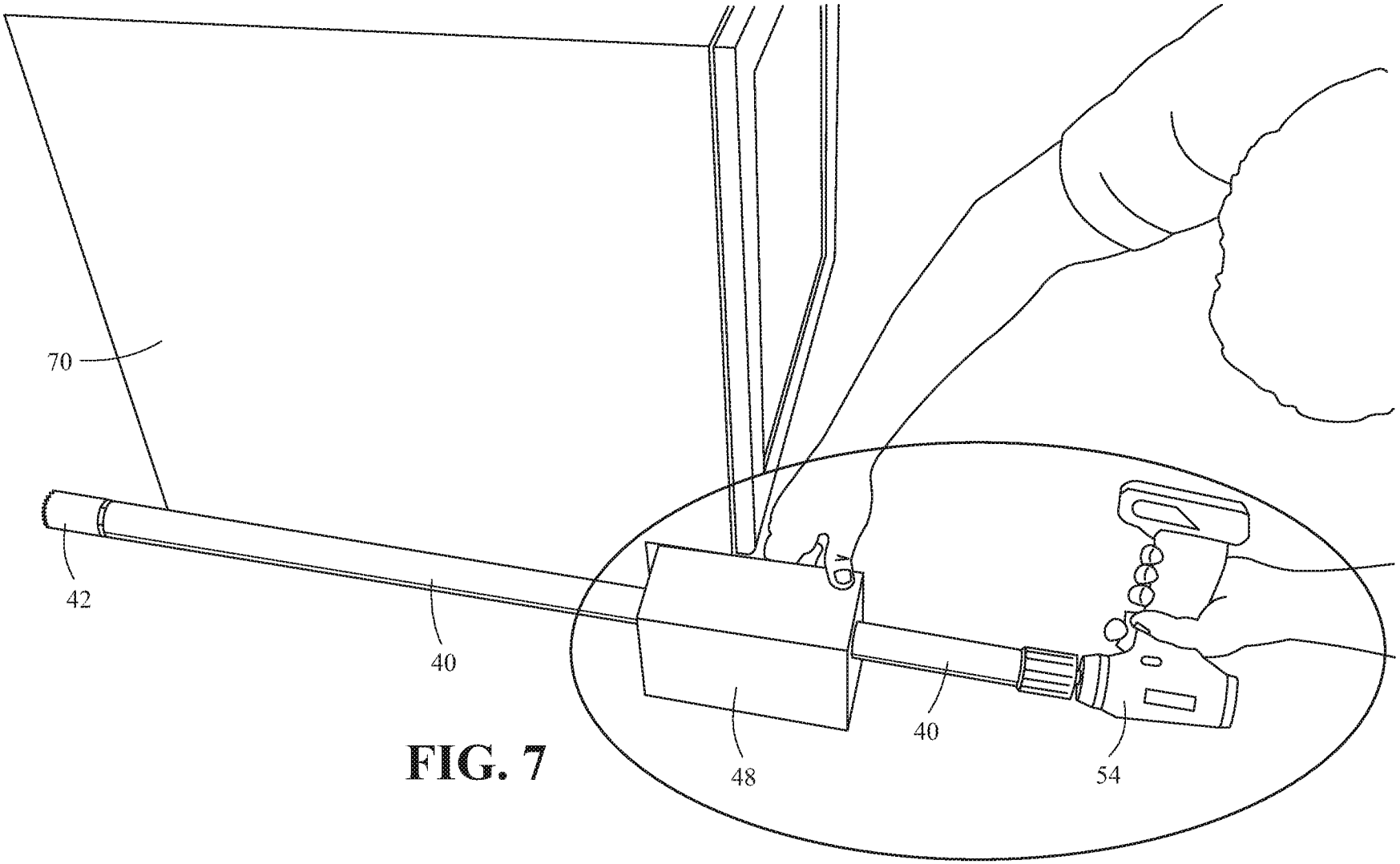
FIG. 7 shows another exemplary embodiment of the drill, drilling rod, kickstand guide, and hole saw/drilling bit (which are some of the components of the drying system kit of the present invention) joined together and positioned on the outside of the cabinet to show how the components would lie inside the cabinet after drilling.

FIG. 7 shows another exemplary embodiment of the drill tool 54, drilling rod 40, kickstand guide 48, and drill bit/hole saw 42 (which are some of the components of the drying system kit of the present invention) joined together and positioned on the outside of the cabinet 70 to show how the components would lie inside the cabinet 70 after drilling. As can be seen in FIG. 7, the drilling rod 40 moves through the opening in the kickstand guide 48 when drilling so that the drill tool 54 ends up much closer to kickstand guide 48 after drilling. Drill bit/hole saw 42 preferably drills into the wall behind the cabinet 70 to ensure that complete drying takes place when using the drying system of the present invention.

Figure 8:
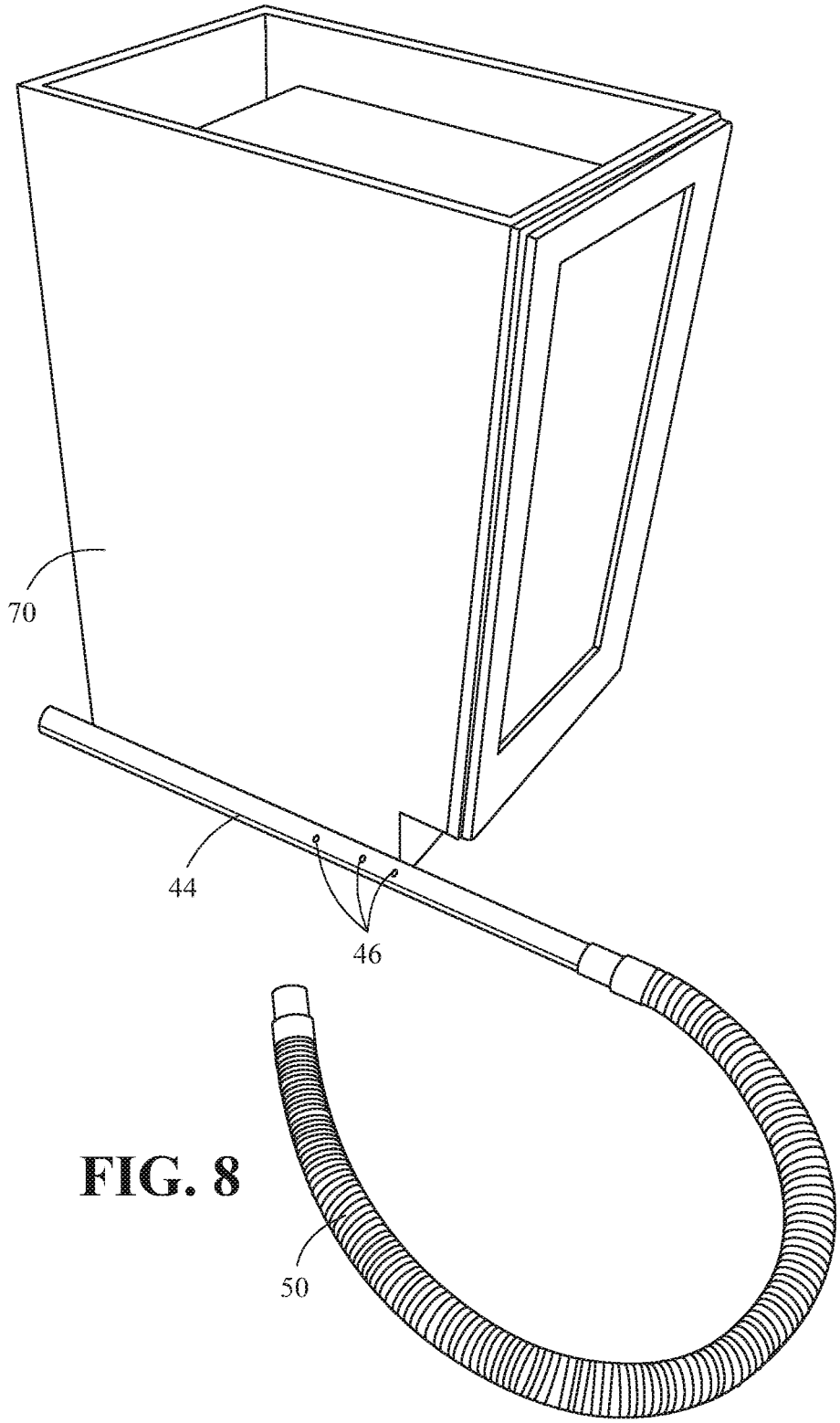
FIG. 8 shows an air flow rod connected to a flexible hose member (which are some of the components of the drying system kit of the present invention) positioned on the outside of the cabinet to show how the air flow rod would lie inside the cabinet once inserted into the cabinet for drying.
Figure 9:
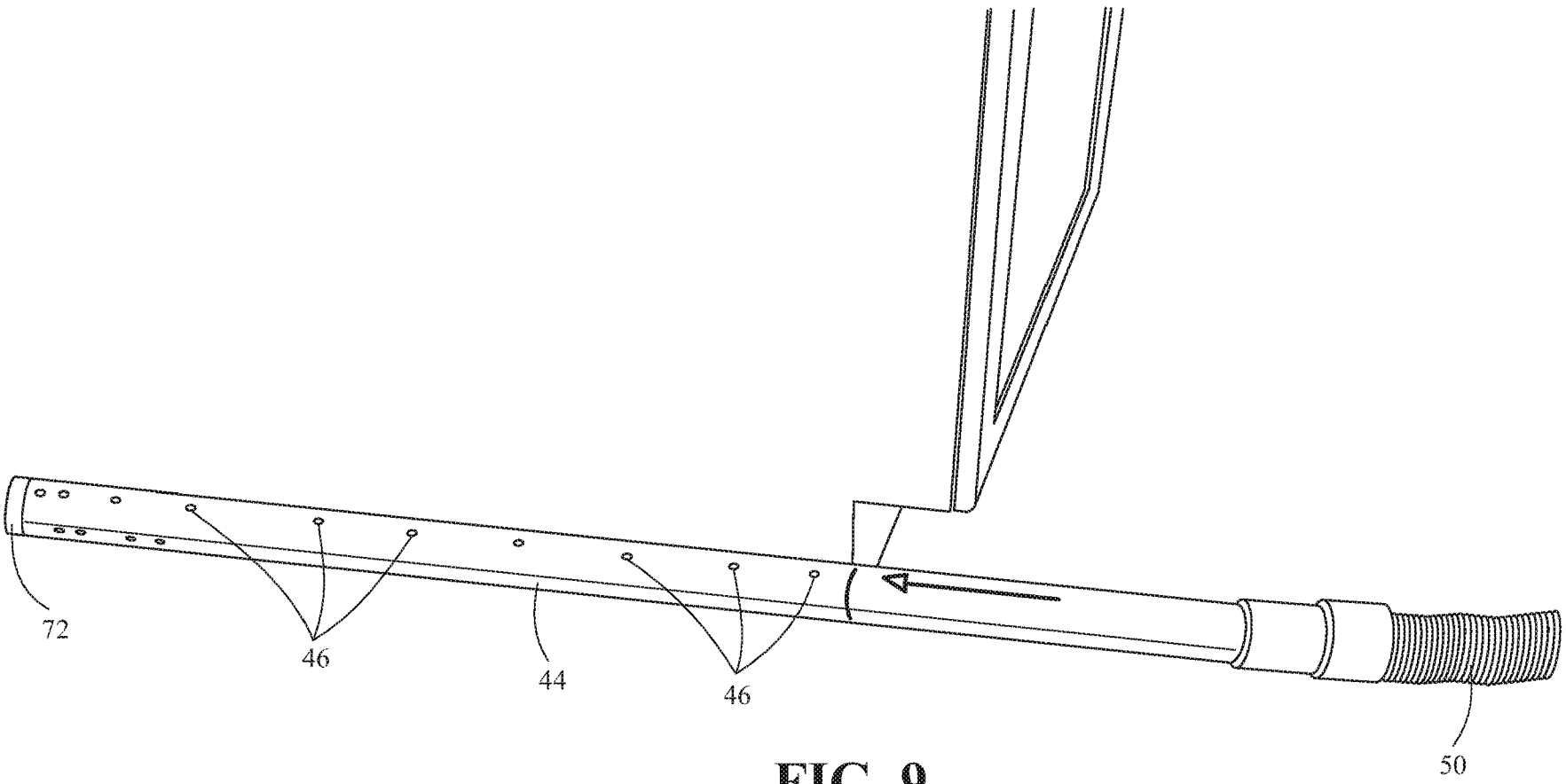
FIG. 9 is a partial view of what is shown in FIG. 8 with the addition of an end cap having a plurality of holes therethrough placed over the open end of the air flow rod which would extend into the wall behind the cabinet during drying.

FIG. 8 shows an air flow rod 44 having openings 46 along its length connected to a flexible hose member 50 (which are some of the components of the drying system kit of the present invention) positioned on the outside of the cabinet 70 to show how the air flow rod 44 would lie inside the cabinet 70 once inserted into the cabinet 70 for drying. Once the drill bit/hole saw 42 is drilled into the back of the cabinet 70 and/or the wall behind the cabinet 70, the drill bit/hole saw 42, the kickstand guide 48, and the drilling rod 40 are moved out of and away from the cabinet 70 and an air flow rod 44 having openings 46 positioned along its length is inserted into the hole in the cabinet 70 created by the drill bit/hole saw 42 until it reaches the back of the cabinet 70 and/or the wall behind the cabinet 70. Before inserting the air flow rod 44 into the cabinet, an end cap 72 having a plurality of openings therethrough may be positioned over the end of the air flow rod 44 before inserting it into the cabinet 70. (See FIG. 9) This will enable air having high air pressure combined with high air flow to escape through the openings 46 along the length of the air flow rod 44 and the openings in the end cap 72 on the air flow rod 44 so that effective and efficient drying of the cabinet and its surrounding structures can take place. After placement of the air flow rod 44 and end cap 72 into the cabinet and/or wall behind the cabinet, one end of a flexible hose member 50 is connected to the end of the air flow rod 44 that is not contained within the cabinet and/or wall behind the cabinet and the other end of the flexible hose member 50 is connected to one of the circular shaped openings 22 and/or cylindrical tube members 24 contained in the cover member 20 of the drying apparatus 10.

Figure 10:
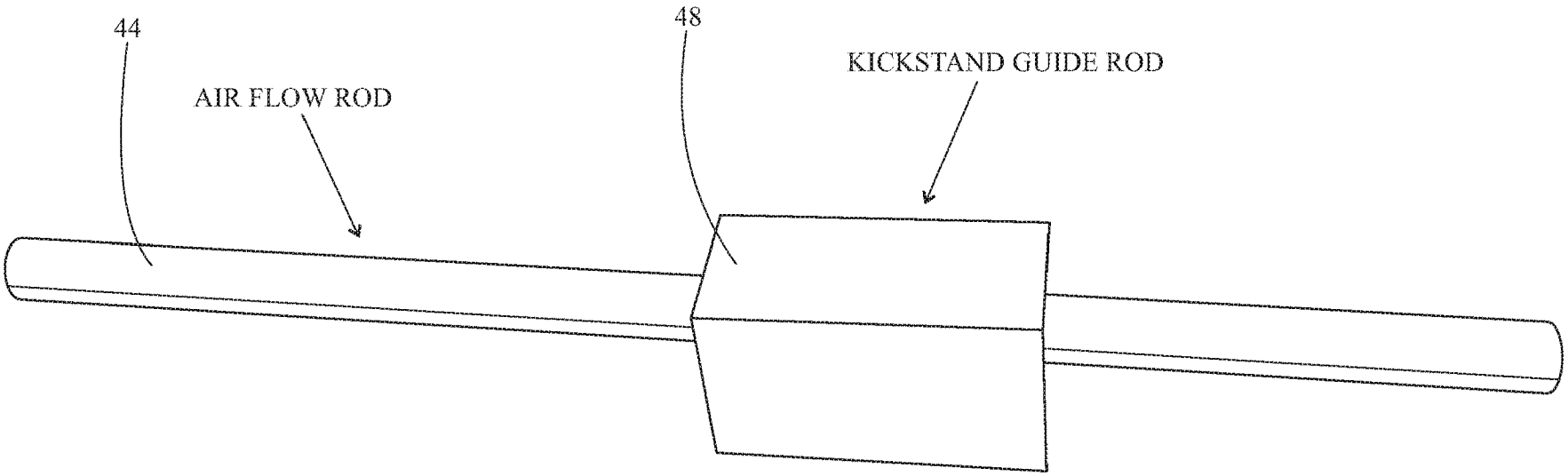
FIG. 10 shows an exemplary kickstand guide and exemplary air flow rod inserted through the kickstand guide which are both components of the drying system kit of the present invention.

FIG. 10 shows an exemplary kickstand guide and exemplary air flow rod inserted through the kickstand guide which are both components of the drying system kit of the present invention. After using the kickstand guide 48 with the drilling rod 40 for drilling into cabinet 70, air flow rod 44 can also be inserted through kickstand guide 48 to support the position of the air flow rod 44 while forcing air through air flow rod 44 and into the cabinet 70 during drying with drying apparatus 10.

Figure 11:
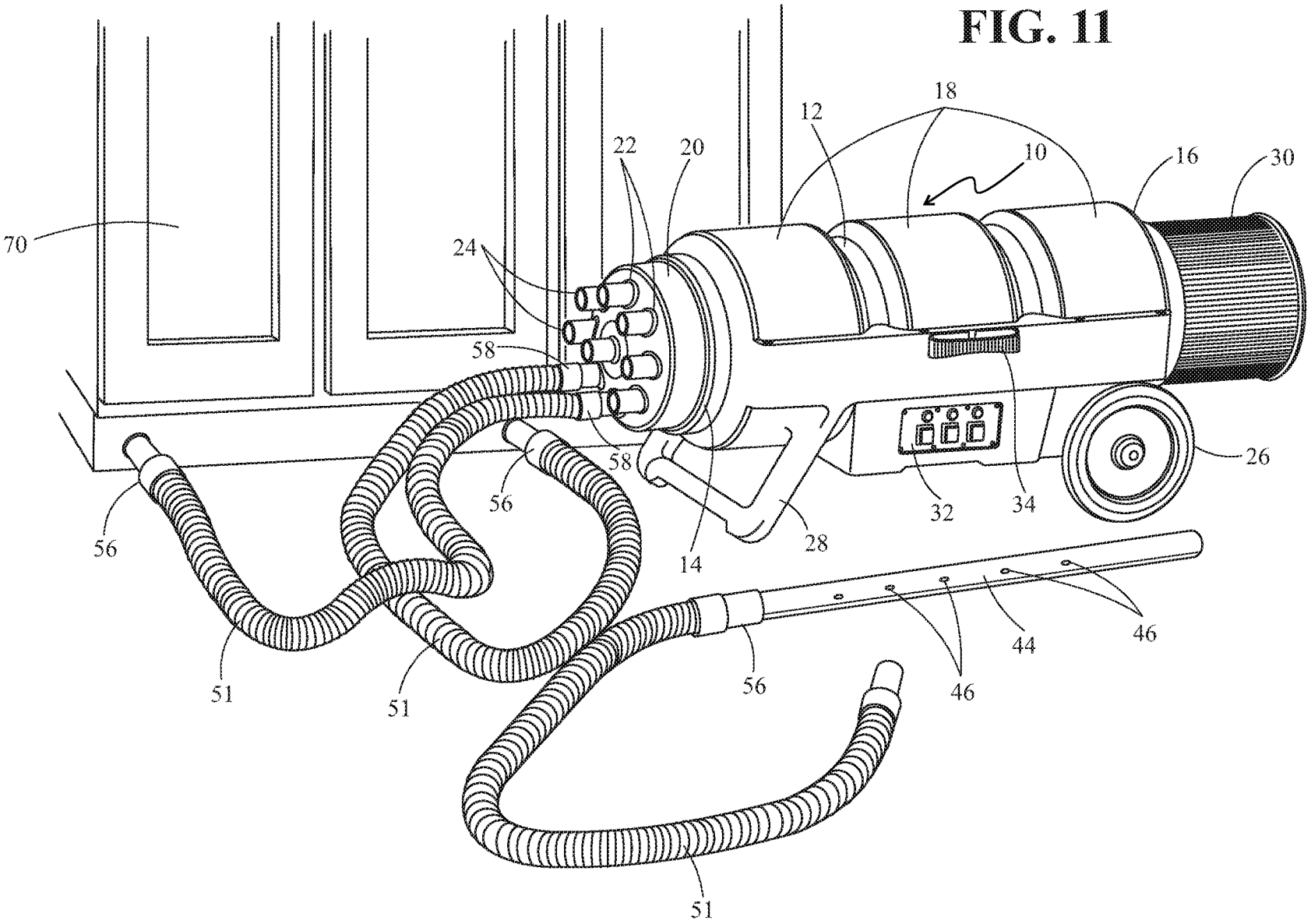
FIG. 11 is a perspective view showing the drying apparatus of the present invention and various components of the drying system kit of the present invention during use.

A perspective view showing the drying apparatus 10 of the present invention and various components of the drying system kit of the present invention during use is shown in FIG. 1. As shown in FIG. 11, a flexible hose member 50 can be cut into a plurality of hose members 51 which are each connected to one end of an air flow rod 44 having openings 46 along its length that has been inserted into a hole drilled into a cabinet 70 and/or a wall behind cabinet 70. The other end of hose members 51 are each connected to one of the cylindrical tube members 24 and/or the circular shaped openings 22 of cover member 20 of drying apparatus 10. The hose members 51 can be connected to one another and/or the air flow rods 44 using a first connector member 56 and to the cylindrical tube members 24 and/or circular shaped openings 22 of cover member 20 using a second connector member 58.

Figure 12:
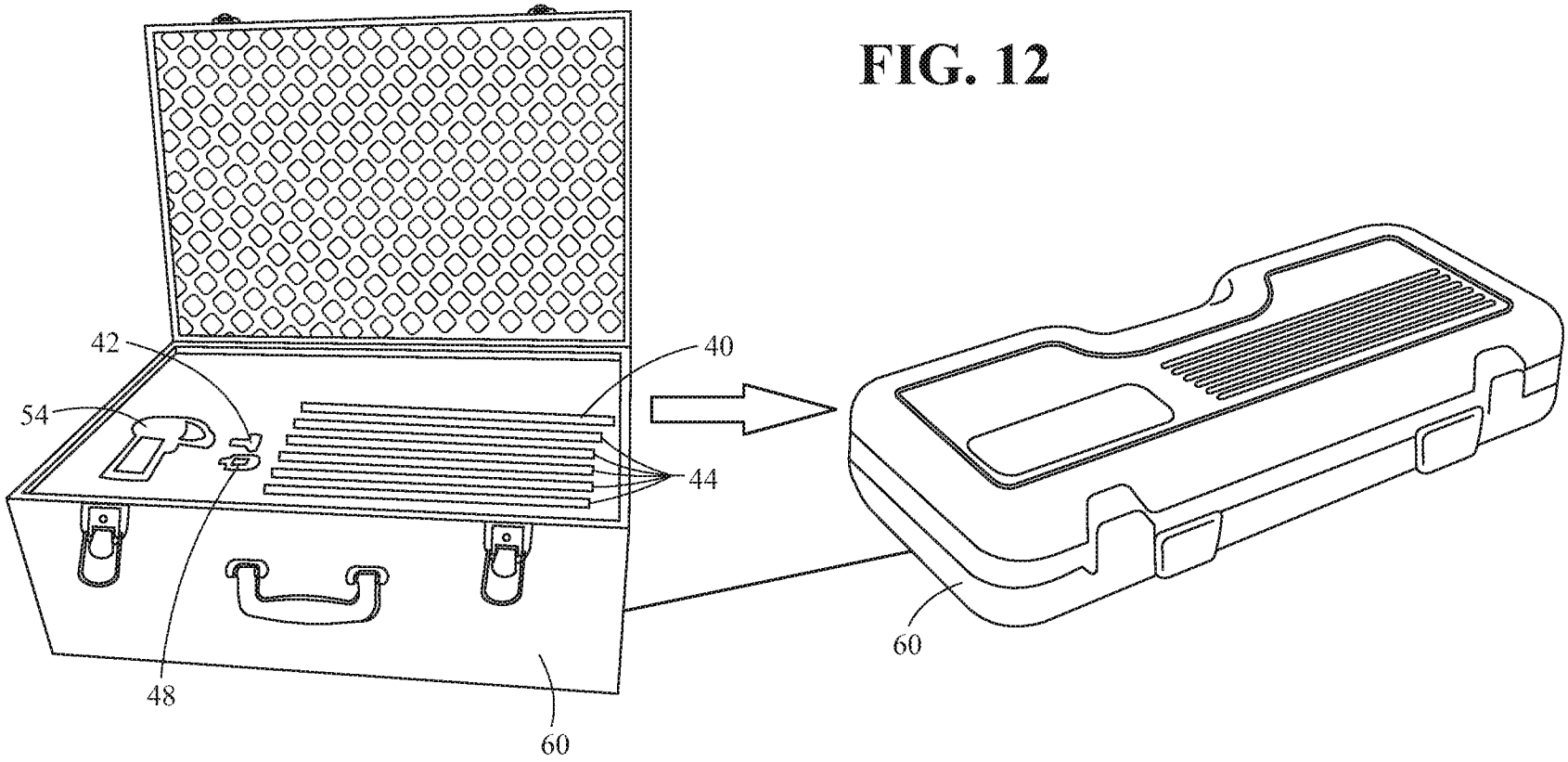
FIG. 12 is a perspective view of a carrying case containing various components of the drying system kit of the present invention.
Figure 13:
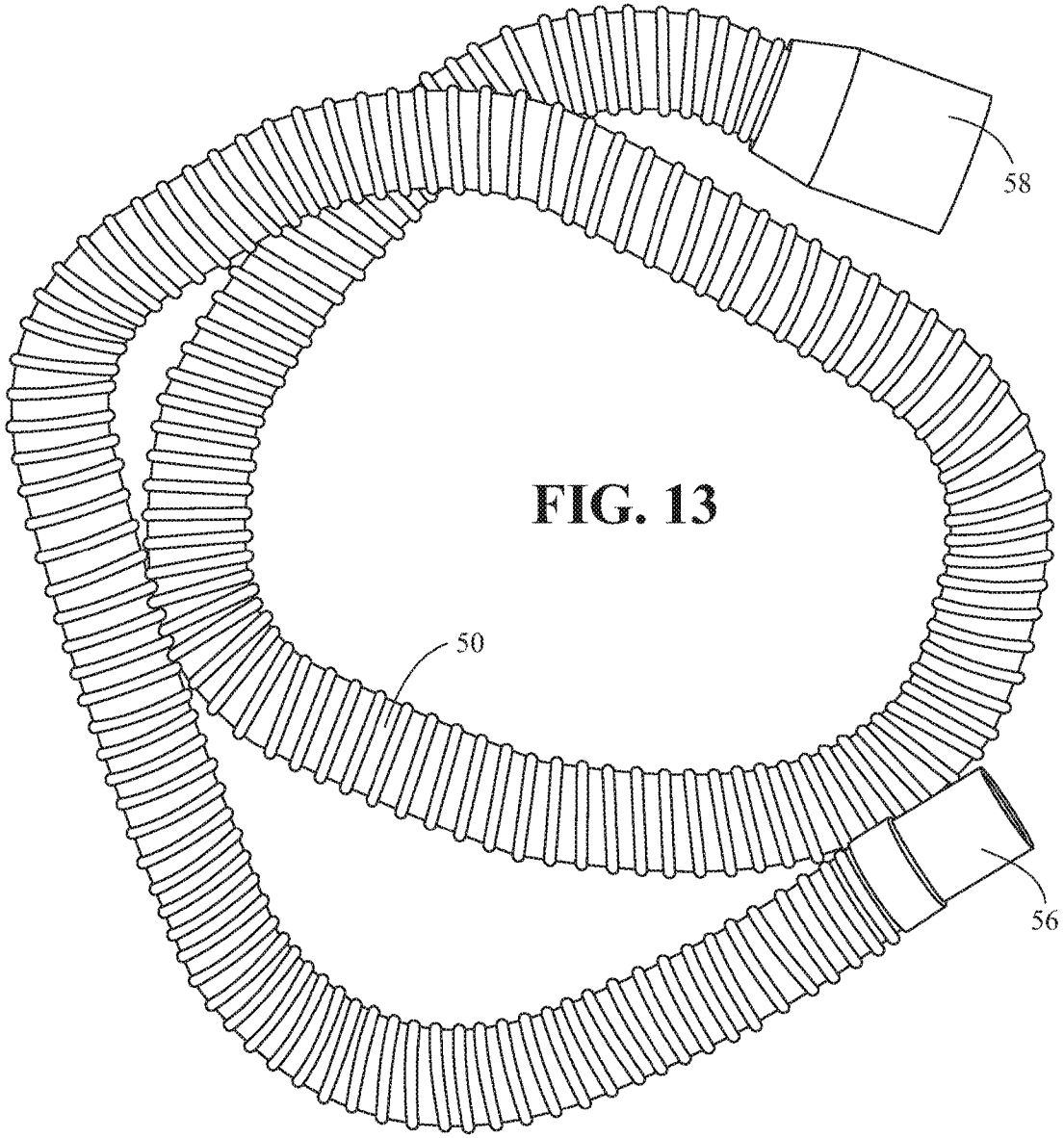
FIG. 13 is an exemplary embodiment of the flexible hose member of the present invention having connector members for attaching the flexible hose member to other components of the drying system kit of the present invention.

FIG. 13 is an exemplary embodiment of the flexible hose member 50 of the present invention having connector members 56, 58 for attaching the flexible hose member to other components of the drying system kit of the present invention. As previously mentioned, flexible hose member 50 can be cut into a plurality of hose members 51 having varying lengths and connector members 56, 58 can be used to connect the hose members 51 to other components of the drying system. FIG. 12 is a perspective view of a carrying case 60 containing various components of the drying system kit of the present invention. Any number of components of drying system kit may be contained within the carrying case 60 depending on the size and configuration of the carrying case 60. The exemplary carrying case 60 shown in FIG. 12 includes a drill tool 54, a drill bit/hole saw 42, a kickstand guide 48, a drilling rod 40, and a plurality of air flow rods 44. The flexible hose member 50 shown in FIG. 13 may be contained within a separate carrying bag or sack.

The detailed description of exemplary embodiments of the invention herein shows various exemplary embodiments of the invention. These exemplary embodiments and modes are described in sufficient detail to enable those skilled in the art to practice the invention and are not intended to limit the scope, applicability, or configuration of the invention in any way. Rather, the following disclosure is intended to teach both the implementation of the exemplary embodiments and modes and any equivalent modes or embodiments that are known or obvious to those reasonably skilled in the art. Additionally, all included examples are non-limiting illustrations of the exemplary embodiments and modes, which similarly avail themselves to any equivalent modes or embodiments that are known or obvious to those reasonably skilled in the art.

Other combinations and/or modifications of structures, arrangements, applications, proportions, elements, materials, or components used in the practice of the instant invention, in addition to those not specifically recited, can be varied or otherwise particularly adapted to specific environments, manufacturing specifications, design parameters, or other operating requirements without departing from the scope of the instant invention and are intended to be included in this disclosure.

Unless specifically noted, it is the Applicant's intent that the words and phrases in the specification and the claims be given the commonly accepted generic meaning or an ordinary and accustomed meaning used by those of ordinary skill in the applicable arts. In the instance where these meanings differ, the words and phrases in the specification and the claims should be given the broadest possible, generic meaning. If any other special meaning is intended for any word or phrase, the specification will clearly state and define the special meaning.

The invention claimed is:

1. A drying system kit comprising:

a drying apparatus having a housing with open first and second opposite ends, at least one fan contained within the housing, and a cover member for covering one of the first and second open ends of the housing where the cover member includes a plurality of circular shaped openings;

at least one drilling rod;

at least one of a drill bit and a hole saw that is attachable to said at least one drilling rod;

a plurality of air flow rods each having openings therein contained along a length of the plurality of air flow rods;

at least one kickstand guide through which said at least one drilling rod and at least one of said plurality of air flow rods can be inserted;

a flexible hose member that can be cut into varying lengths; and a plurality of end caps/plugs capable of covering at least one of the plurality of circular shaped openings in the cover member of the drying apparatus, at least one open end of at least one of the plurality of air flow rods, and at least one open end of the flexible hose member.

2. The drying system kit of claim 1 further comprising a drill tool that can be connected to said at least one drilling rod.

3. The drying system kit of claim 1 further comprising at least one first connector member for coupling one or more of a plurality of hose members that have been cut from the flexible hose member.

4. The drying system kit of claim 3 further comprising at least one second connector member for attaching the one or more of a plurality of hose members to the plurality of circular shaped openings in the cover member of the drying apparatus.

5. The drying system kit of claim 1 further comprising a carrying case for retaining said at least one drilling rod, said at least one of a drill bit and hole saw, said plurality of air flow rods, said at least one kickstand guide, and said plurality of end caps.

6. The drying system kit of claim 5 wherein the flexible hose is also retained within the carrying case.

7. The drying system kit of claim 2 further comprising a carrying case for retaining said at least one drilling rod, said at least one of a drill bit and hole saw, the plurality of air flow rods, said at least one kickstand guide, the plurality of end caps, and the drill tool.

8. The drying system kit of claim 7 wherein the flexible hose is also retained within the carrying case.

9. A drying system kit comprising:

a drying apparatus having a housing with open first and second opposite ends, at least one fan contained within the housing, and a cover member for covering one of the first and second open ends of the housing where the cover member includes a plurality of circular shaped openings;

at least one drilling rod;

at least one of a drill bit and a hole saw that is attachable to said at least one drilling rod;

a plurality of air flow rods each having openings therein contained along a length of the air flow rod;

at least one kickstand guide through which said at least one drilling rod and at least one of said plurality of air flow rods can be inserted; and a flexible hose member that can be cut into varying lengths.

10. The drying system kit of claim 9 further comprising a plurality of end caps/plugs capable of covering at least one of the plurality of circular shaped openings in the cover member of the drying apparatus, at least one open end of at least one of the plurality of air flow rods, and at least one open end of the flexible hose member.

11. The drying system kit of claim 9 wherein the drying apparatus includes at least three sequentially positioned fans contained within the housing.

12. The drying system kit of claim 9 further comprising a drill tool that can be connected to said at least one drilling rod.

13. The drying system kit of claim 9 further comprising a plurality of cylindrical tube members wherein each cylindrical tube member is connected to one of the plurality of circular shaped openings in the cover member such that the cylindrical tube members extend away from the interior of the housing.

14. The drying system kit of claim 9 further comprising at least one first connector member for coupling one or more of a plurality of hose members that have been cut from the flexible hose member.

15. The drying system kit of claim 9 wherein the drying apparatus further comprises at least one wheel member connected to the housing near the second end of the housing.

16. The drying system kit of claim 15 wherein the drying apparatus further comprises a support/handle member connected to the housing near the first open end of the housing for holding the first open end of the housing above a lowermost position of the at least one wheel member.

17. The drying system kit of claim 9 wherein the drying apparatus further comprises a filter member connected to the open second end of the housing.

18. The drying system kit of claim 11 wherein the drying apparatus further comprises control means for separately activating the three sequentially positioned fans.

19. The drying system kit of claim 9 further comprising a carrying case for retaining said at least one drilling rod, said at least one of a drill bit and hole saw, said plurality of air flow rods, and said flexible hose member.

20. The drying system kit of claim 9 further comprising a carrying case for retaining said at least one drilling rod, said at least one of a drill bit and hole saw, said plurality of air flow rods, said at least one kick stand guide, and said flexible hose member.

21. The drying system kit of claim 12 further comprising a carrying case for retaining said at least one drilling rod, said at least one of a drill bit and hole saw, said plurality of air flow rods, said drill tool, and said flexible hose member.

* * * * *